US010675522B2

(12) United States Patent
Galian et al.

(10) Patent No.: US 10,675,522 B2
(45) Date of Patent: Jun. 9, 2020

(54) SACK TOSS GAME AND METHOD OF PLAY

(71) Applicants: Carl Galian, West Islip, NY (US); Anthony Pappone, West Islip, NY (US)

(72) Inventors: Carl Galian, West Islip, NY (US); Anthony Pappone, West Islip, NY (US)

( * ) Notice: Subject to any disclaimer, the term of this patent is extended or adjusted under 35 U.S.C. 154(b) by 0 days.

(21) Appl. No.: 16/357,125

(22) Filed: Mar. 18, 2019

(65) Prior Publication Data

US 2020/0001157 A1 Jan. 2, 2020

Related U.S. Application Data

(60) Provisional application No. 62/691,881, filed on Jun. 29, 2018.

(51) Int. Cl.
*A63B 67/06* (2006.01)
*A63B 63/08* (2006.01)

(52) U.S. Cl.
CPC ..... *A63B 67/06* (2013.01); *A63B 63/08* (2013.01); *A63B 2210/50* (2013.01)

(58) Field of Classification Search
CPC ..... A63B 67/06; A63B 63/08; A63B 2210/50
See application file for complete search history.

(56) References Cited

U.S. PATENT DOCUMENTS

| | | | | |
|---|---|---|---|---|
| 3,495,830 | A | 2/1970 | Farrelli | |
| 3,761,087 | A * | 9/1973 | Meyer | A63B 67/06 473/470 |
| 5,056,795 | A * | 10/1991 | Buhrow | A63B 63/08 273/400 |
| 5,067,727 | A * | 11/1991 | Crompton | A63B 67/06 273/336 |
| 5,871,216 | A | 2/1999 | Sparacino | |
| 9,550,101 | B2 | 1/2017 | Janeri | |
| 2008/0116644 | A1 | 5/2008 | Knoernschild | |
| 2009/0115136 | A1 | 5/2009 | Voden | |
| 2015/0273301 | A1 | 10/2015 | Zierenberg | |
| 2016/0192783 | A1 | 7/2016 | Kelly | |

* cited by examiner

*Primary Examiner* — Jeffrey S Vanderveen
(74) *Attorney, Agent, or Firm* — Charles Runyan

(57) ABSTRACT

A target game system; the target game system including at least one target assembly including a base, a plate, a support pole and a receptacle; and a plurality of projectiles. The target game system includes a fun, new and improved twist on sack toss games by providing new rules and new means of playing the game. The sack toss game may be referred to as "LazySaxs".

12 Claims, 8 Drawing Sheets

SACK TOSS GAME AND METHOD OF PLAY

CROSS REFERENCE TO RELATED APPLICATION

The present application is related to and claims priority to U.S. Provisional Patent Application No. 62/691,881 filed Jun. 29, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of games and more specifically relates to a sack toss game.

2. DESCRIPTION OF RELATED ART

Cornhole or bean bag toss (also known regionally as baggo, bags, sack toss, or bean sack) is a lawn game in which players take turns throwing bags of corn (or bean bags) at a raised platform with a hole in the far end. The game is typically played by two or more participants and comprises the use of several weighted bags known as beanbags, and two wedge-shaped goals. Each goal has a hole on its angled top surface, and the object of the game is to toss a beanbag into the hole. This is a very popular game at social gatherings, especially outdoors during nice weather. Whilst there have been minor variations of the game, the rules and the form the game is played in (standing up) has remained for the most part unchanged. Thus, a suitable solution is desired.

U.S. Pub. No. 2015/0273301 to Richard A. Zierenberg relates to a launch-a-load. The described launch-a-load includes a bean bag game consisting of two toilet seat game pieces and nine bean bags. The toilet seats are placed 25 feet apart and players throw the bean bags at the toilet seat game pieces to score points or lose points.

BRIEF SUMMARY OF THE INVENTION

In view of the foregoing disadvantages inherent in the known games art, the present disclosure provides a novel sack toss game and method of play. The general purpose of the present disclosure, which will be described subsequently in greater detail, is to provide a fun, new and improved twist on sack toss games by providing new rules and new means of playing the game.

A target game system is disclosed herein. The target game system includes at least one target assembly which may include a base which may be configured to contact and engage a ground-surface. A plate may be provided may have a projectile receiving surface, the projectile receiving surface may have a first game-point location and a second game-point location. A support pole may connect the plate to the base. Further, a receptacle may be attached to substantially a middle of the projectile receiving surface of the plate, the receptacle may have an open-top and an inner-capacity configured to receive at least one projectile. The inner-capacity may have a third game-point location. A plurality of projectiles may also be provided for use with the at least one target assembly.

A method of using the target game system is also disclosed herein. The method of using the target game system may comprise the steps of: providing the target game system as above; providing a first player of the two or more players a first predetermined amount of the plurality of projectiles; providing a second player of the two or more players a second predetermined amount of the plurality of projectiles; throwing each of the first predetermined amount of the plurality of projectiles, one by one, at the at least one target assembly; receiving a first score, the first score being calculated based on a location of each of the first predetermined amount of the plurality of projectiles on the at least one target assembly; throwing each of the second predetermined amount of the plurality of projectiles, one by one, at the at least one target assembly; receiving a second score, the second score being calculated based on a location of each of the second predetermined amount of the plurality of projectiles on the at least one target assembly; and determining a winner out of the two or more players by a comparison of the first score and the second score.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a sack toss game and method of play, constructed and operative according to the teachings of the present disclosure.

The various embodiments of the present invention will hereinafter be described in conjunction with the appended drawings, wherein like designations denote like elements.

DETAILED DESCRIPTION

Figure 1:
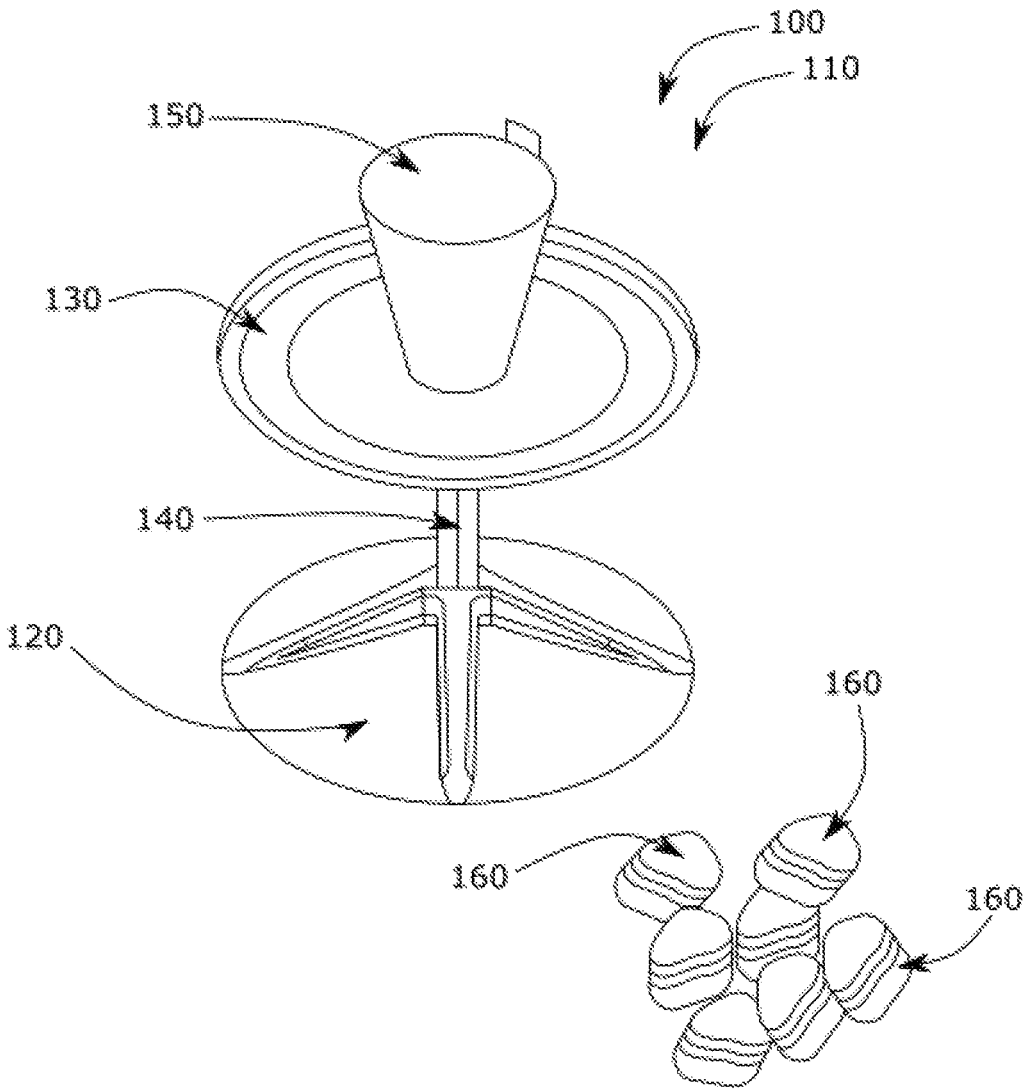
FIG. 1 is a front perspective view of the target game system during an 'in-use' condition, according to an embodiment of the disclosure.

As discussed above, embodiments of the present disclosure relate to games and more particularly to a sack toss game and method of play as used to provide a novel sack toss game.

Generally, a sack toss game is disclosed herein. The sack toss game may include at least one target which is referred to as the "LazySaxs" of the game. The at least one target may include a base configured to support the target on a ground-surface; a support pole extending vertically therefrom; a plate including a raised-lip periphery; and a receptacle attached at a center of the plate. The receptacle may include a nub member protruding from an outer-edge. In one embodiment, the base may be used for standing on any hard-surface. In other embodiments, users may choose to use the base on a soft-surface. Further, a spike-member may be provided to plant the at least one target into the soft-surface. Examples of soft-surfaces contemplated may include grass, sand, etc. In this instance, the spike-member may serve as an anchor. Further, the game may include a plurality of sacks configured for throwing. In addition to this, chairs may be utilized as part of the game. The chairs may be provided as part of a kit or a user may utilize chairs they already have. The chair may be a beach chair. Further, a set of instructions may be provided outlining at least four different methods of play for the game.

Each area on the target may represent a point. For example, landing a sack on the plate may equal one point. Landing a sack in the receptacle may equal three points. Landing a sack hanging off the plate may equal one point. Landing a sack hanging on the receptacle may equal two points. Landing a sack on the nub member may be an automatic win. If a sack lands in an unreachable distance for the opponent to pick up without getting out of their chair, one point may be deducted (unless the "toodling rule" is applied). The toodling rule is when a player convinces a surrounding person to provide the unreachable sack to their opponent. If sacks are thrown out of reach of opponent and that player already got fifteen points on a previous throw, then it is an automatic loss.

In a preferred embodiment, the game may be played sitting, however embodiments are envisioned whereby the game may be played standing or sitting. The game may be good for building upper body muscle, especially when the game is played sitting. The game may further be a game of dexterity and skill. In addition to this, the game may be played anywhere, meaning it is a form of outdoor and indoor entertainment.

There may be four methods of play. One of the four methods of play may be called "Simple SaxS". For "Simple SaxS", two targets may be used and placed three to four strides apart. A chair may be placed behind each of the two targets. Four sacks may be utilized. A first player may toss all of their four sacks and total their score. This method of play may be played to fifteen. The winner must win by two points.

Another of the four methods of play may be called "Classic Competition SaxS" and may be preferably played by two players. Two of the targets may be placed four strides apart (or eight feet), and again one chair may be placed behind each of the two targets. Only four sacks may be utilized. To begin, first player to throw is the player whose birthday is closest to August 24th. If a player goes over fifteen points with their last throw, the amount of points they would have received are deducted from their score. If the first player scores fifteen points, a second player still has opportunity to throw and tie the game. If the second player ties the game, they need to throw their remaining sacks and not go over or under fifteen points. The game continues until a player wins by two points.

Another of the four methods of play may be called "Circle SaxS" which may be played by three to four players. One target may be placed in an open area and three or four chairs may be placed surrounding the target, approximately two to three strides away (or six feet). Each player may receive two sacks. In this method of play, the first player is the player whose birthday is closest to September 8th, and that player can place the nub member in any direction they choose. The first player may throw one sack, and play may move clockwise through the players. In this method of play, there may be no deduction for going over fifteen points, but the winner must win by two points.

Yet another of the four methods of play may be called "4 players team classic SaxS". Two targets may be utilized and placed three to four strides apart (or eight feet). Two chairs may be placed next to each other, slightly behind each of the two targets. The players may be divided into teams and one player from each team may take two sacks. In this method of play, the first player is the player who went to bed the latest the night before (if a tie, whoever woke up earliest). The sacks are thrown one by one and the game is played to exactly fifteen points. The teams must throw all of their sacks, even if they reach fifteen points before. If a player goes over fifteen points with their last throw, the amount of points they would have received are deducted from their score. The game continues until one team wins by two points.

Referring now more specifically to the drawings by numerals of reference, there is shown in FIGS. 1-9, various views of a target game system 100.

FIG. 1 shows a target game system 100 according to an embodiment of the present disclosure. As illustrated, the target game system 100 may include at least one target assembly 110 including a base 120, a plate 130, support pole 140, and a receptacle 150; and a plurality of projectiles 160. In one embodiment, the target game system 100 may further include a chair. In addition, the at least one target assembly 110 may include a set of user instructions. In one embodiment (or method of play), the at least one target assembly 110 may be two or more target assemblies. Preferably, the target game system 100 may also include a carry bag for storing and carrying the at least one target assembly 110 and the plurality of projectiles 160 therein.

Figure 2A:
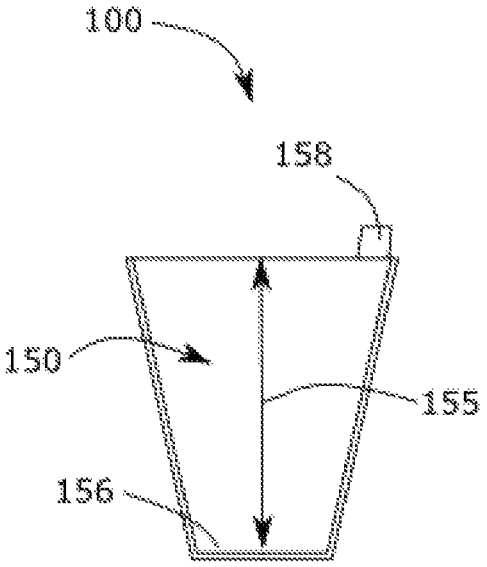
FIG. 2A is a side perspective view of the target game system of FIG. 1, according to an embodiment of the present disclosure.
Figure 2B:
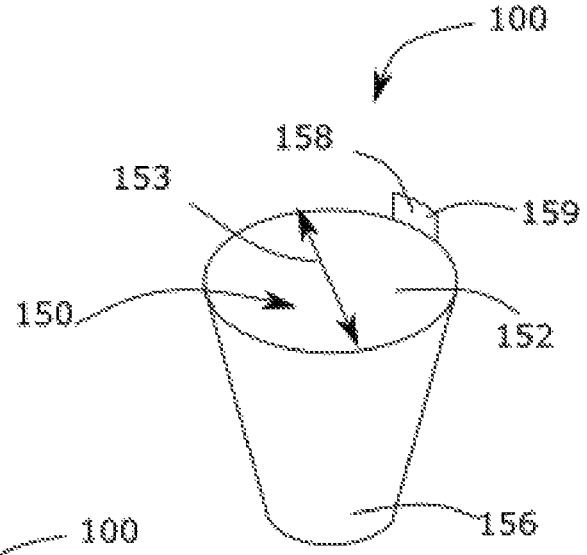
FIG. 2B is a top-front perspective view of the target game system of FIG. 1, according to an embodiment of the present disclosure.
Figure 2C:
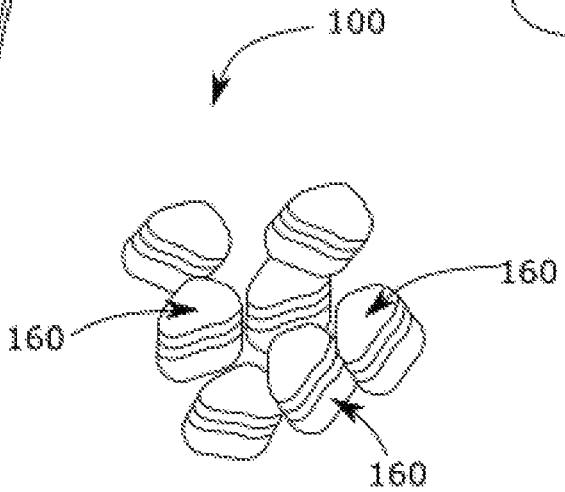
FIG. 2C is a top-front perspective view of the target game system of FIG. 1, according to an embodiment of the present disclosure.
Figure 3A:
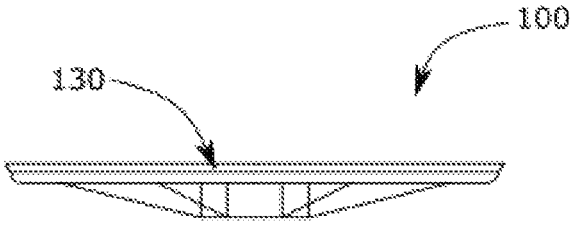
FIG. 3A is a side perspective view of the target game system of FIG. 1, according to an embodiment of the present disclosure.
Figure 3B:
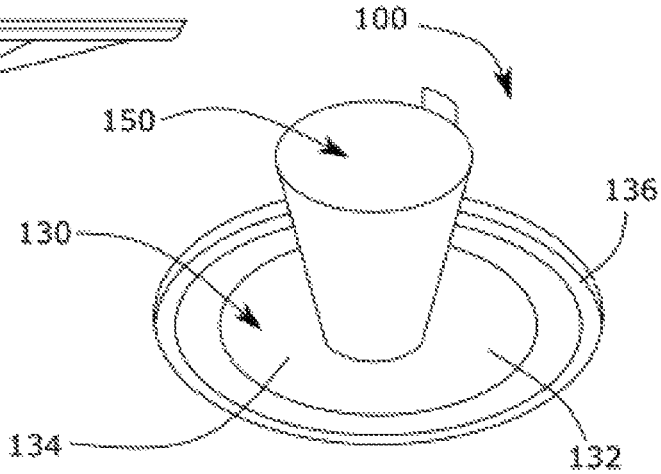
FIG. 3B is a top-side perspective view of the target game system of FIG. 1, according to an embodiment of the present disclosure.
Figure 4A:
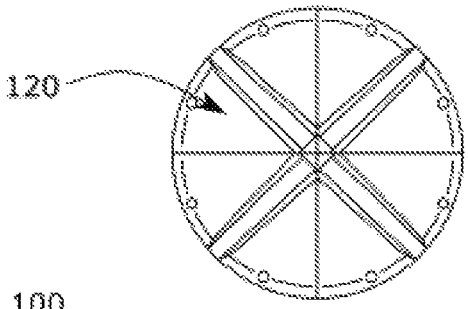
FIG. 4A is a top perspective view of the target game system of FIG. 1, according to an embodiment of the present disclosure.
Figure 4B:
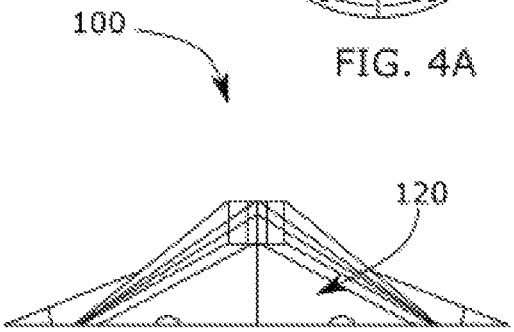
FIG. 4B is a side perspective view of the target game system of FIG. 1, according to an embodiment of the present disclosure.
Figure 4C:
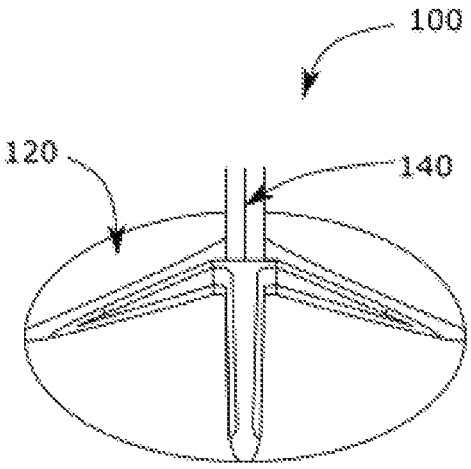
FIG. 4C is a top-front perspective view of the target game system of FIG. 1, according to an embodiment of the present disclosure.
Figure 5A:
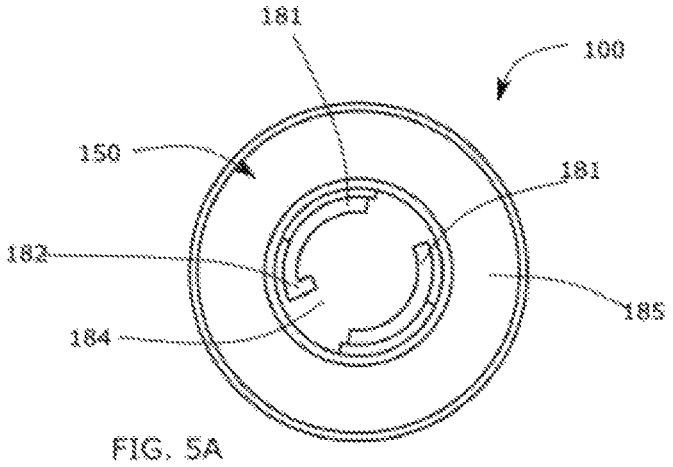
FIG. 5A is a bottom perspective view of the target game system of FIG. 1, according to an embodiment of the present disclosure.
Figure 5B:
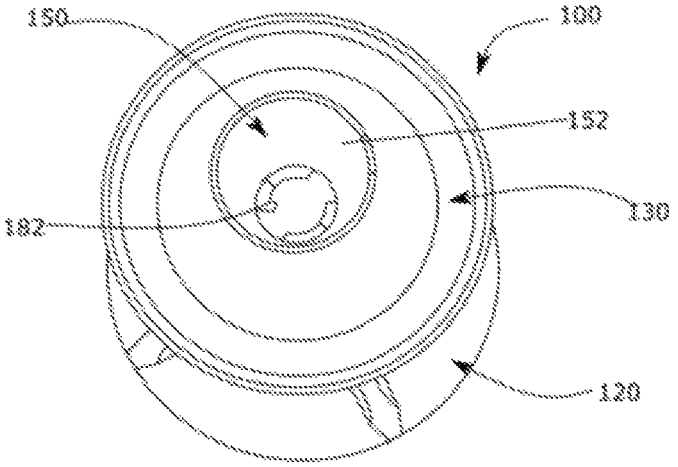
FIG. 5B is a top-side perspective view of the target game system of FIG. 1, according to an embodiment of the present disclosure.
Figure 5C:
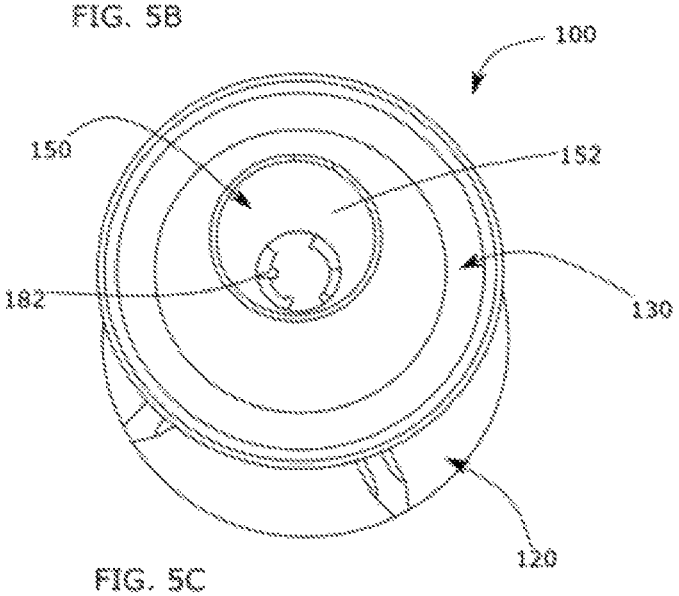
FIG. 5C is a top-side perspective view of the target game system of FIG. 1, according to an embodiment of the present disclosure.
Figure 6A:
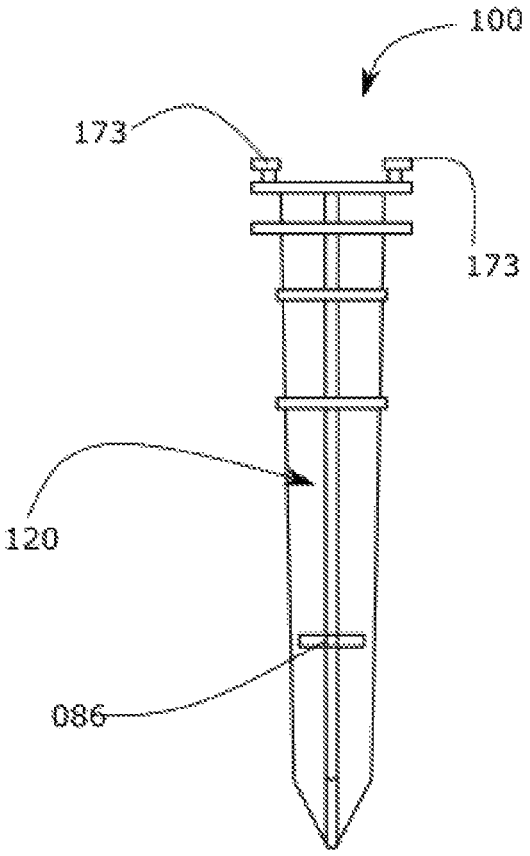
FIG. 6A is a side perspective view of the target game system of FIG. 1, according to an embodiment of the present disclosure.
Figure 6B:
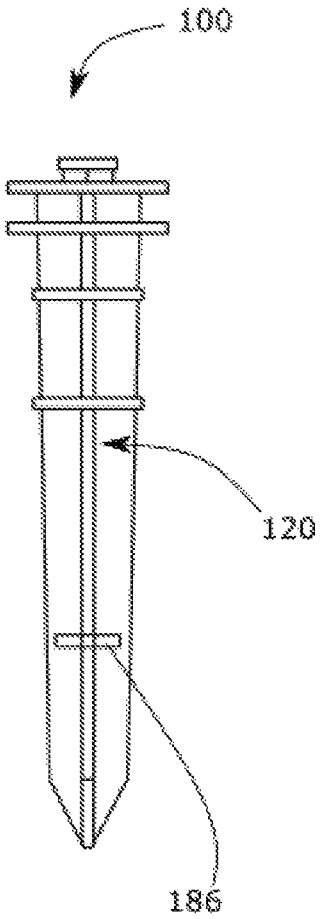
FIG. 6B is a front perspective view of the target game system of FIG. 1, according to an embodiment of the present disclosure.
Figure 6C:
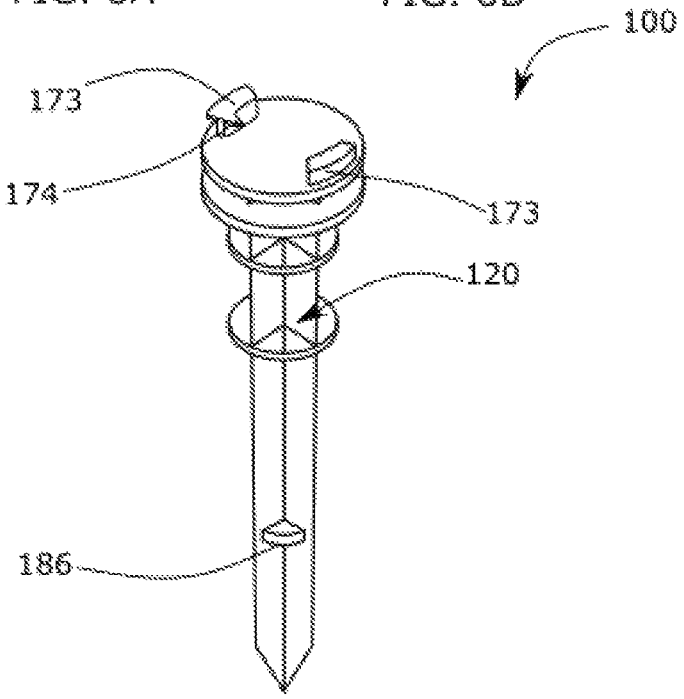
FIG. 6C is a side-top perspective view of the target game system of FIG. 1, according to an embodiment of the present disclosure.
Figure 7:
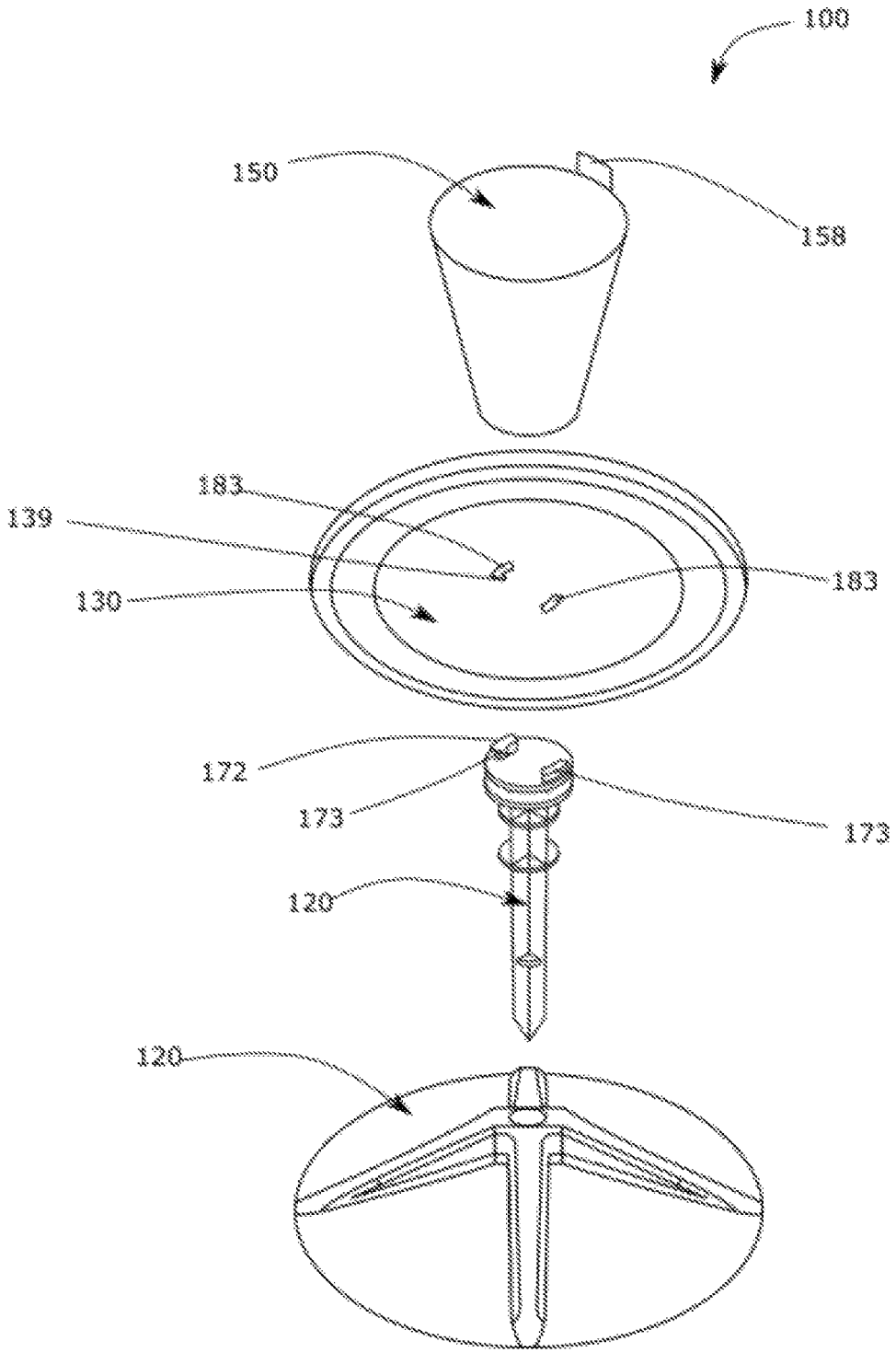
FIG. 7 is a side-top perspective view of the target game system of FIG. 1, according to an embodiment of the present disclosure.

FIGS. 2A-2C show various perspective views of the target game system 100 of FIG. 1, according to an embodiment of the present disclosure. The receptacle 150 may have the open-top 152 and an inner-capacity 155 configured to receive at least one projectile, the inner-capacity 155 having a third game-point location 156. Further, as shown, the receptacle 150 may include a nub-member 158 located on a periphery of the open-top 152. The nub-member 158 may include a fourth game-point location 159.

As shown, the plurality of projectiles 160 may be a plurality of sacks. In particular, the plurality of projectiles 160 may be exactly eight projectiles. Preferably, the open-top 152 of the receptacle 150 may include a diameter 153 larger than a size of each of the plurality of projectiles 160 such that the open-top 152 is able to accept the plurality of projectiles 160. Further, preferably, the receptacle 150 may include a capacity 155 configured to receive and hold at least two projectiles from the plurality of projectiles 160.

FIGS. 3A-7 shows various perspective views of the target game system 100 of FIG. 1, according to an embodiment of the present disclosure. The base 120 may be configured to contact and engage a ground-surface. As shown, the base 120 may be circular in shape. The plate 130 may have a projectile receiving surface 132, the projectile receiving surface 132 having a first game-point location 134 and a second game-point location 136. As shown, the plate 130 may be circular in shape. As shown here, the receptacle 150 may be cylindrical in shape. Further, the base 120, the plate 130 and the receptacle 150 may be concentric.

As shown, the support pole 140 may connect the plate 130 to the base 120. In addition, the receptacle 150 may be attached to substantially a middle of the projectile receiving surface 132 of the plate 130. The support pole 140 may include a first-end 171 and a second-end 172 opposite the first-end 171. To aid in assembly of the plate 130, support pole 140 and the receptacle 150, the second-end 172 may include at least two protrusions 173 extending therefrom, each of the at least two protrusions 173 being opposite each other. Preferably, at least one of the at least two protrusions 173 may include an angled notch 174.

Further, the receptacle 150 may include a bottom 185 opposite the open-top 152, and the bottom 185 may include a first set of two apertures 181 opposite each other, and a port 184 therebetween. The port 184 may be configured to receive the support pole 140 therein and the first set of two apertures may be configured to mate with the at least two protrusions 173. Further, the plate 130 may include a second set of two apertures 183 configured to receive the at least two protrusions 173 therethrough. The at least two protrusions 173 may be inserted through the second set of two apertures 183 on the plate 130 to attach the support pole 140 to the plate 130, and then mate with the first set of two apertures 181 on the receptacle 150 to attach the support pole 140 and the plate 130 to the receptacle 150.

Preferably, at least one of the first set of two apertures 181 may include an angled groove 182. The angled notch 174 may be configured to slot into the angled groove 182, and further configured to lock the support pole 140 within the port 184. In this embodiment, the plate 130 may include functional decorative indicia. Preferably, when the angled notch 174 slots into the angled groove 182, the support pole 140 may be locked into the port 184 such that the functional decorative indicia is opposite the nub-member 158 of the receptacle 150. Further to this, the support pole 140 may include a stop 186 to prevent the support pole from being twisted too far when being locked into the port 184. The functional decorative indicia may read "LazySaxs". As shown, the plate 130 may further include a second angled groove 139 on one of the second set of two apertures 183 configured to accept the angled notch 174 therethrough.

Figure 8:
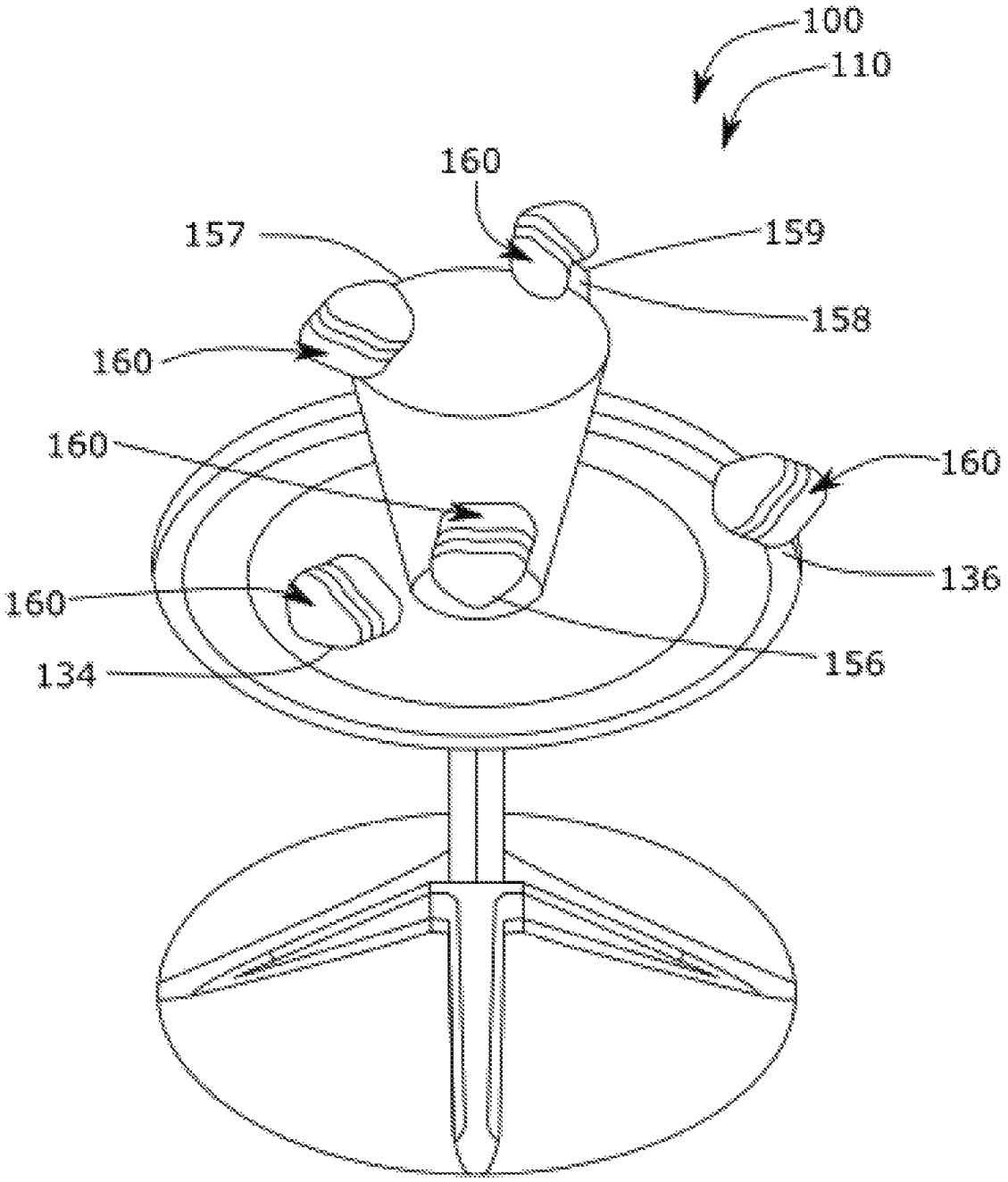
FIG. 8 is a side-top perspective view of the target game system of FIG. 1, according to an embodiment of the present disclosure.

FIG. 8 shows a front perspective view of the target game system 100 of FIG. 1, according to an embodiment of the present disclosure. Shown here is the target game system 100 in use showing various points on the at least one target assembly 110, each indicated by a location of each of the plurality of projectiles 160. The first game-point location 134 may be representative of one point; the second-game point location 136 may be representative of one point; and the third game-point location 156 may be representative of three-points. Further, as shown, the receptacle 150 may include a fifth game-point location 157 representative of two points. In addition to this, as discussed above the nub-member 158 may include the fourth game-point location 159. The fourth game-point location 159 may be representative of the automatic win.

Figure 9:
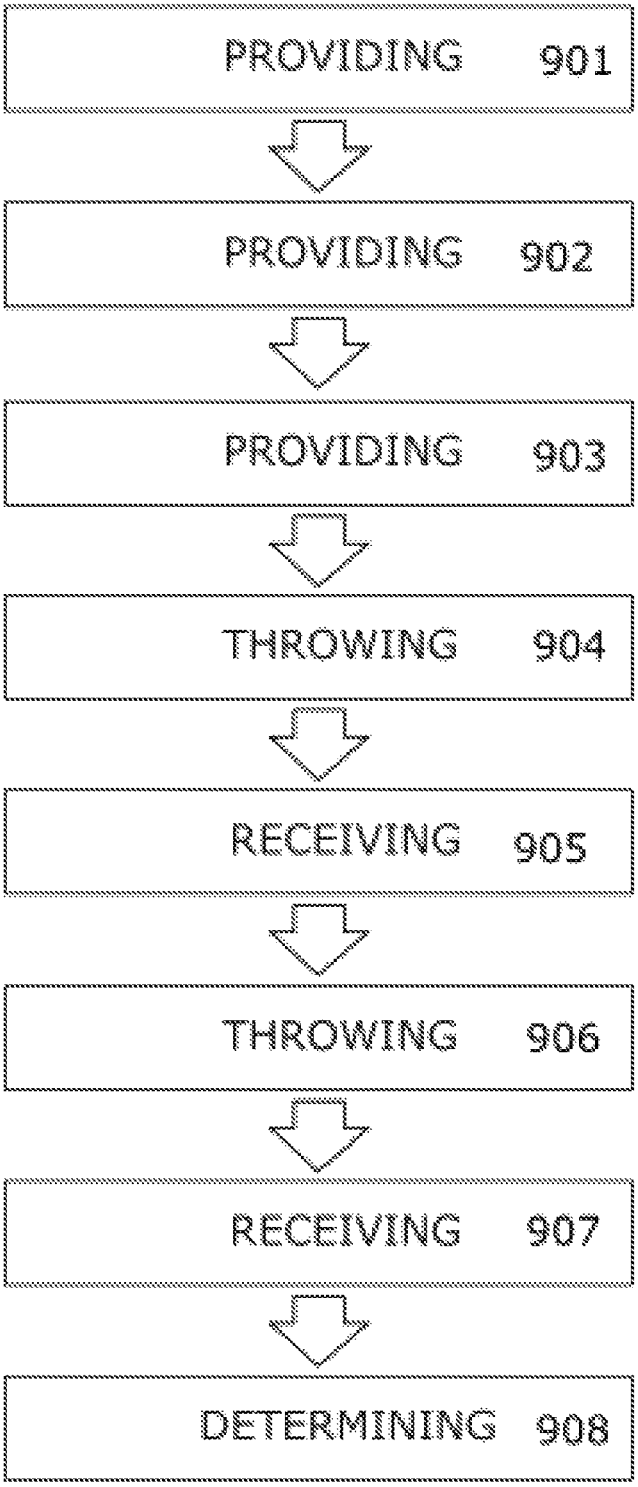
FIG. 9 is a flow diagram illustrating a method of use for the target game system, according to an embodiment of the present disclosure.

FIG. 9 is a flow diagram illustrating a method of playing a target game system with two or more players 900, according to an embodiment of the present disclosure. As illustrated, the method of playing a target game system with two or more players 900 may include the steps of: providing 901 the target game system as above; providing 902 a first player of the two or more players a first predetermined amount of the plurality of projectiles; providing 903 a second player of the two or more players a second predetermined amount of the plurality of projectiles; throwing 904 each of the first predetermined amount of the plurality of projectiles, one by one, at the at least one target assembly; receiving 905 a first score, the first score being calculated based on a location of each of the first predetermined amount of the plurality of projectiles on the at least one target assembly; throwing 906 each of the second predetermined amount of the plurality of projectiles, one by one, at the at least one target assembly; receiving 907 a second score, the second score being calculated based on a location of each of the second predetermined amount of the plurality of projectiles on the at least one target assembly; and determining 908 a winner out of the two or more players by a comparison of the first score and the second score. In another embodiment, the game may alternatively be played with at least two seated players.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for target game system 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A target game system comprising:

at least one target assembly including:

a base configured to contact and engage a ground-surface;

a plate having a projectile receiving surface, the projectile receiving surface having a first game-point location and a second game-point location;

a support pole connecting the plate to the base; and a receptacle attached centrally to the projectile receiving surface of the plate, the receptacle having an open-top and an inner-capacity configured to receive at least one projectile, the inner-capacity having a third game-point location; and a plurality of projectiles;

wherein the support-pole includes a first-end and a second-end opposite the first-end, and wherein the second-end includes at least two protrusions extending therefrom, each of the at least two protrusions being opposite each other; and wherein at least one of the at least two protrusions includes an angled notch.

2. The target game system of claim 1, wherein the receptacle includes a nub-member located on a periphery of the open-top.

3. The target game system of claim 1, wherein the first game-point location is representative of one point.

4. The target game system of claim 1, wherein the second game-point location is representative of one point.

5. The target game system of claim 1, wherein the third game-point location is representative of three points.

6. The target game system of claim 1, wherein the receptacle is substantially cylindrical in shape.

7. The target game system of claim 1, wherein the open-top of the receptacle includes a diameter larger than a size of each of the plurality of projectiles.

8. The target game system of claim 1, wherein the receptacle includes a capacity configured to receive and hold at least two projectiles from the plurality of projectiles.

9. The target game system of claim 1, wherein the base is circular in shape.

10. The target game system of claim 1, wherein the plate is circular in shape.

11. A target game system comprising:

at least one target assembly including:

a base configured to contact and engage a ground-surface;

a plate having a projectile receiving surface, the projectile receiving surface having a first game-point location and a second game-point location;

a support pole connecting the plate to the base; and a receptacle attached centrally to the projectile receiving surface of the plate, the receptacle having an open-top and an inner-capacity configured to receive at least one projectile, the inner-capacity having a third game-point location; and a plurality of projectiles;

wherein the support-pole includes a first-end and a second-end opposite the first-end, and wherein the second-end includes at least two protrusions extending therefrom, each of the at least two protrusions being opposite each other;

wherein the receptacle includes a bottom opposite the open-top, and wherein the bottom includes a first set of two apertures opposite each other, and a port therebetween;

wherein the port is configured to receive the support-pole therein;

wherein at least one of the first set of two apertures includes an angled groove;

wherein at least one of the at least two protrusions includes an angled notch;

wherein the two apertures are configured to mate with the two protrusions; and wherein the angled notch is configured to slot into the angled groove, and further configured to lock the support-pole within the port.

12. A target game system comprising:

at least one target assembly including:

a base configured to contact and engage a ground-surface;

a plate having a projectile receiving surface, the projectile receiving surface having a first game-point location and a second game-point location;

a support pole connecting the plate to the base; and a receptacle attached centrally to projectile receiving surface of the plate, the receptacle having an open-top and an inner-capacity configured to receive at least one projectile, the inner-capacity having a third game-point location; and a plurality of projectiles;

wherein the support-pole includes a first-end and a second-end opposite the first-end, and wherein the second-end includes at least two protrusions extending therefrom, each of the at least two protrusions being opposite each other;

wherein the receptacle includes a bottom opposite the open-top, and wherein the bottom includes a first set of two apertures opposite each other, and a port therebetween;

wherein the plate includes a second set of two apertures configured to receive the two protrusions therethrough.

* * * * *